United States Patent [19]

Manspeaker

[11] 4,009,903

[45] Mar. 1, 1977

[54] RETRACTABLE SEAT

[76] Inventor: Robert O. Manspeaker, 2160 Pendleton, Memphis, Tenn. 38114

[22] Filed: June 22, 1972

[21] Appl. No.: 265,172

[52] U.S. Cl. ..... 297/14

[51] Int. Cl.[2] ..... A47C 9/06

[58] Field of Search ..... 297/14, 331, 332, 147; 248/240.2, 240.1; 108/48, 34, 38, 40, 39

[56] References Cited

UNITED STATES PATENTS

| | | | |
|---|---|---|---|
| 1,502,152 | 7/1924 | Millett | 108/40 X |
| 1,605,550 | 11/1926 | Krugly | 248/240.2 |
| 1,655,516 | 1/1928 | Simpson | 108/38 X |
| 1,695,370 | 12/1928 | Fain | 108/40 |
| 1,765,168 | 6/1930 | Laursen | 108/40 |
| 2,203,394 | 6/1940 | Schieber | 108/38 |
| 2,807,512 | 9/1957 | Blink | 108/38 |
| 2,909,399 | 10/1959 | Wasson et al. | 297/147 X |
| 2,964,093 | 12/1960 | Lohr | 248/429 |
| 3,696,762 | 10/1972 | Holdham | 297/332 X |

*Primary Examiner*—James T. McCall
*Attorney, Agent, or Firm*—John R. Walker, III

[57] ABSTRACT

A seat for movement from an open, usable position to a closed, stored position including a stationary frame mounted on a vertical support and a movable seat assembly having bearings to coact with the stationary frame and having foldable legs that rest on a horizontal support when the seat assembly is in the open position.

6 Claims, 7 Drawing Figures

RETRACTABLE SEAT

BACKGROUND OF THE INVENTION

1. Field of the Invention

This invention relates generally to seats, and more specifically, to retractable seats that are to be mounted on a stationary support.

2. Description of the Prior Art

Previous devices in the same general field have the seat member movable from an open to a closed position by a simple pivoting action. The face of the seat member in these previous devices has been disposed toward the vertical support when in the closed position. The following U.S. patents are known to be in the same general field as the present invention: Schoonmaker Pat. No. 424,730; Krugly Pat. No. 1,605,550; and Purcell Pat. No. 2,965,153. None of the above patents shows the concept of the present invention.

SUMMARY OF THE INVENTION

The present invention is directed towards overcoming the disadvantages and problems in providing seating that can be retracted to a compact, out of the way position and still be attractive. The concept of the present invention is to provide a retractable seat assembly in which a stationary frame is mounted onto a vertical support and a seat member is movably attached to the frame member through bearings and is supported from a horizontal support when in an open position by legs pivotally attached thereto. The seat assembly moves from the open position to the closed position by the bearings sliding upward in the stationary frame and pivoting downward. When fully closed, the face portion of the seat member is disposed outwardly from the vertical support, thereby providing at attractive and pleasing appearance as well as providing outwardly facing cushion means. Thus, if the retractable seat is used in a room in which there is considerable activity, as for example, in a gym, the possibility of someone getting hurt when he bumps against the retracted seat is substantially eliminated. This is in contrast to previous seats in which the underneath portions of the seats were outwardly exposed.

DESCRIPTION OF THE PREFERRED EMBODIMENT

Figure 1:
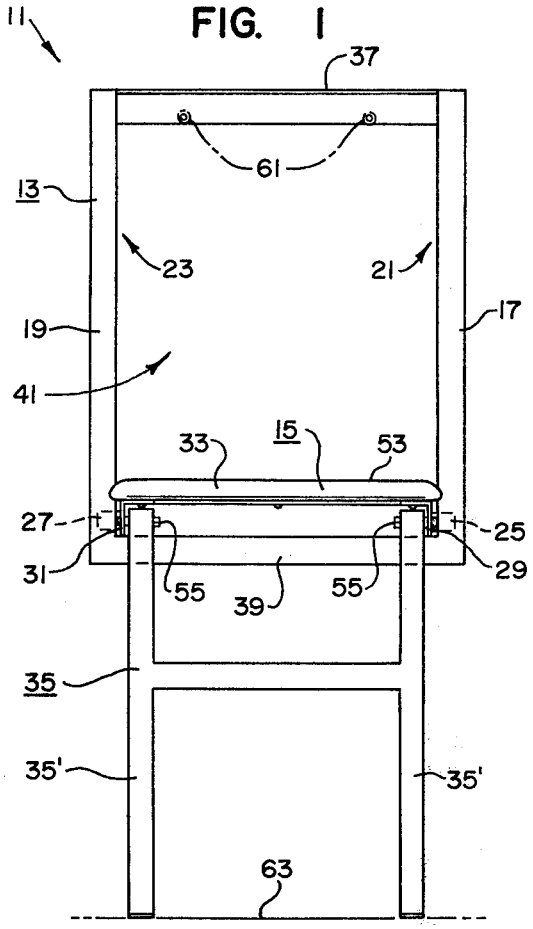
FIG. 1 shows a front view of the retractable seat in an open position.
Figure 2:
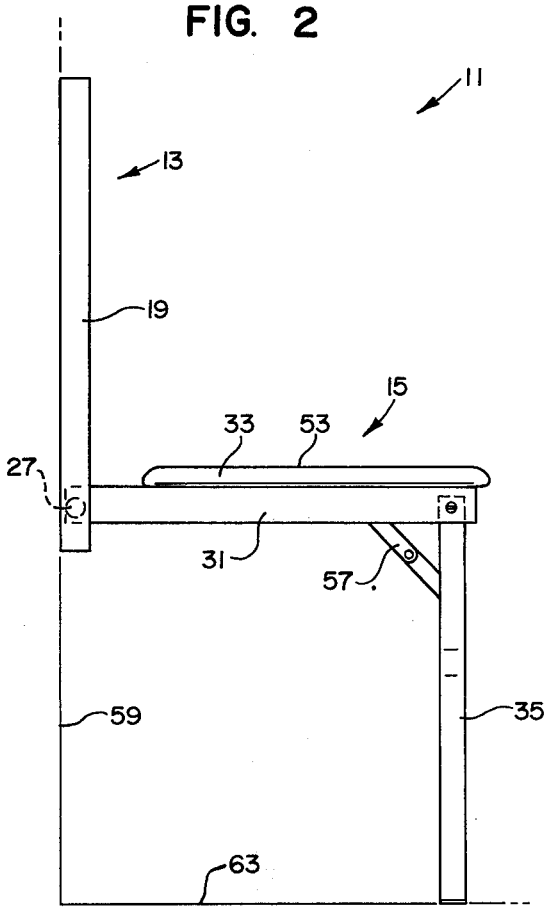
FIG. 2 shows a side view of the retractable seat in an open position.
Figure 3:
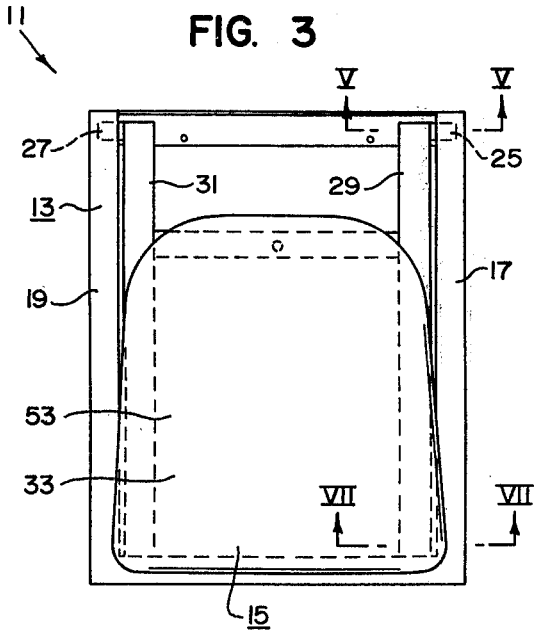
FIG. 3 shows a front view of the retractable seat in a closed position.
Figure 4:
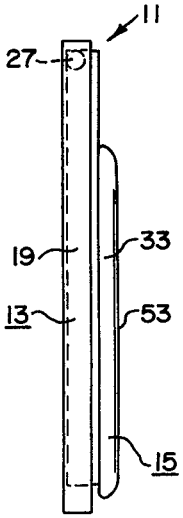
FIG. 4 shows a side view of the retractable seat in a closed position.
Figure 5:
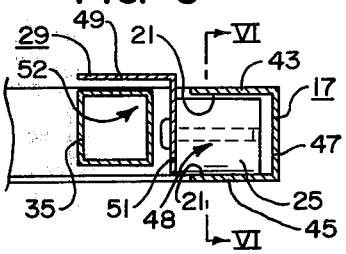
FIG. 5 is a sectional view of the retractable seat as taken on line V—V of FIG. 3.
Figure 6:
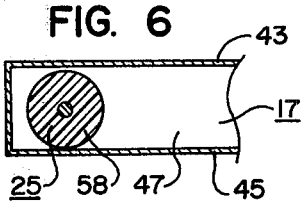
FIG. 6 is a sectional view of the retractable seat as taken on the line VI—VI of FIG. 5.
Figure 7:
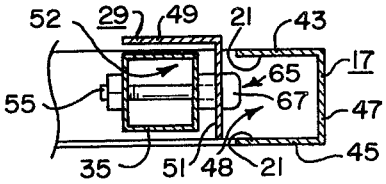
FIG. 7 is a sectional view of the retractable seat as taken on the line VII—VII of FIG. 3 with some parts removed from clarity.

The retractable seat 11 of the present invention is adapted for movement between an open, usable position as shown in FIGS. 1 and 2 and a closed, compact position as shown in FIGS. 3 and 4. The retractable seat

11 includes a stationary frame 13 and a movable seat assembly 15. The stationary frame 13 includes first and second vertical members 17, 19, respectively, defining first and second vertical tracks 21, 23. The movable seat assembly 15 includes first and second bearings 25, 27 for movably contacting the first and second vertical tracks 21, 23, respectively; first and second arms 29, 31, respectively attached to the first and second bearings 25, 27; a seat member 33, which is preferably cushioned, attached to the first and second arms 29, 31, respectively; and a leg means 35 attached to the first and second arm means 29, 31, and having at least one downwardly extending leg portion 35'. In the preferred embodiment shown there are two leg portions 35', but one centrally disposed leg portion 35' may be provided without departing from the spirit and scope of the present invention.

The stationary frame 13 includes a top member 37 and a bottom member 39 rigidly joined by the first and second vertical members 17, 19, respectively, defining an open centered rectangle 41. Each of the first and second vertical members 17, 19 includes a front member 43, a rear member 45, and a side member 47 defining a channel 48 opening towards the center of the stationary frame 13. The front member 43 and the rear member 45 of the first and second vertical members 17, 19, respectively, define the first and second vertical tracks 21, 23. Each of the first and second arms 29, 31 includes a top member 49 and a side member 51 defining a right angle 52 opening towards the center of the stationary frame 13. The seat member 33 has a face surface 53 being outwardly disposed when the retractable seat 11 is in the closed position and upwardly disposed when in the open position. Leg means 35 is attached to the first and second arms 29, 31, respectively, by horizontal pivots 55. An articulated stop 57 is included between the first arm 29 and the leg means 35 to prevent the leg means 35 from pivoting outwardly more than 90° relative to the first and second arms 29, 31, respectively. The first and second bearings 25, 27, respectively, include at least a surface coating of neoprene plastic 58 to allow substantially friction-free movement of the first and second bearings 25, 27, on the first and second vertical tracks 21, 23, respectively.

The stationary frame 13 is mounted on a vertical support 59 such as a wall by screws 61 passing through the top member 37 of the stationary frame 13 and into the vertical support 59. The leg means 35 of the movable seat assembly 15 rests upon a horizontal support 63 such as a floor when the retractable seat 11 is in the open position. To move the retractable seat 11 from the open position to the closed position, the leg means 35 is turned about pivot 55 until it is in a substantially parallel relationship with the first and second arms 29, 31, respectively. The first and second arms 29, 31, are then retracted into the open centered rectangle 41 of the stationary frame 13 by downward pivoting action and upward sliding action of the first and second bearings 25, 27, respectively, in the first and second vertical tracks 21, 23. The face surface 53 of the seat member 33 is outwardly disposed from the vertical support 59 when the retractable seat 11 is in the closed position.

Catch means 65 are provided on the side members 51 of the first and second arms 29, 31, respectively, to coact with the front members 43 of the first and second vertical members 17, 19, respectively, when the retractable seat 11 is in the closed position to help maintain the retractable seat 11 in the closed position when the retractable seat 11 is for use in a movable object such as a boat. It will be noted that the catch means 65 are merely enlarged head portions 67 of the pivots 55. The enlarged head portions 67 are made to frictionally engage the front members 43 of the first and second vertical members 17, 19, respectively, when the retractable seat 11 is being opened or closed and thus substantially hold the retractable seat 11 in a closed position.

Although the invention has been described and illustrated with respect to a preferred embodiment thereof, it is not to be so limited since changes and modifications may be made therein which are within the full intended scope of the invention.

I claim:

1. A retractable seat for movement between an open position and a closed, compact and out of the way position, said retractable seat comprising frame means for attachment to a vertical support, said frame means including first and second vertical members defining first and second vertical tracks, first and second bearing means respectively movably contacting said first and second vertical tracks, first and second arm means respectively attached to said first and second bearing means, a seat member attached to said first and second arm means, leg means pivotally attached to said first and second arm means and adapted to rest on a horizontal support when said retractable seat is in said open position; said first and second arm means with said seat member attached thereto and with said leg means pivoted into a substantially parallel and nesting relationship therewith being retractable from said open position to said closed position with said seat member being substantially flat against and parallel with the vertical support; said frame means including a top member, a bottom member and said first and second vertical members defining an open-centered rectangle, each of said first and second vertical members including a front member, a rear member and a side member defining a channel opening towards the center of said frame means and said front and rear members defining first and second vertical tracks, each of said first and second arm means including a top member and a side member defining a right angle opening towards the center of said frame means, and said first and second arm means with said leg means pivoted into said right angle substantially parallel to and nesting within said first and second arm means being retractable into said open-centered rectangle of said frame means by downward pivoting action and upward sliding action at said bearing means and said first and second vertical track means of said frame means.

2. The retractable seat of claim 1 in which said side members of said first and second arm means include catch means to coact with said front members of said first and second vertical track means when said retractable seat is in said closed position for substantially holding said first and second arm means with said seat means attached thereto in said closed position.

3. The retractable seat in claim 1 in which said first arm means includes stop means to coact with said leg means for restricting pivoting movement of said leg means to 90° relative to said first and second arm means.

4. In combination with a wall member and a floor member, a retractable seat for movement between an open position and a closed, compact and out of the way position, said retractable seat means including a top member, a bottom member, and first and second vertical members defining an open-centered rectangular frame means, each of said first and second vertical members of said frame means including a front member, a rear member, and a side member defining a channel opening towards the center of said frame means, said front and rear members defining first and second vertical tracks, first and second bearing means mounted on said first and second track means of said first and second vertical members of said frame means and including neoprene plastic for substantially friction-free movement thereon, first and second arm means attached respectively to said first and second bearing means and including top and side member defining a right angle opening toward the center of said open-centered rectangle of said frame means, a seat member attached to said first and second arm means and including a face portion, said face portion being outwardly disposed when said retractable seat is in a closed position substantially parallel with said wall member and upwardly disposed when said retractable seat is in an open position substantially parallel with said floor member, a leg means pivotally attached to said first and second arm means and resting on said floor member when said retractable seat is in said open position, and said first and second arm means with said seat means attached thereto and with said leg means pivoted into said right angle substantially parallel to and nesting within said first and second arm means being retractable into said open-centered rectangle of said frame means by downward pivoting action and upward sliding action at said first and second bearing means and said vertical track means of said frame means.

5. The retractable seat of claim 4 in which said side members of said first and second arm means include catch means to coact with said front members of said first and second vertical track means when said retractable seat is in said closed position for substantially holding said first and second arm means with said seat means attached thereto in said closed position.

6. The retractable seat of claim 4 in which said first arm means includes stop means to coact with said leg means for restricting pivoting movement of said leg means to 90° relative to said first and second arm means.

* * * * *